United States Patent [19]

Gappa et al.

[11] 4,439,932

[45] Apr. 3, 1984

[54] METHOD AND APPARATUS FOR THERMAL TREATMENT, ESPECIALLY DRYING, OF FINELY COMMINUTED BULK MATERIAL

[75] Inventors: Günther Gappa, Gelsenkirchen-Buer; Josef Degel, Hattingen; Harald Jüntgen, Essen, all of Fed. Rep. of Germany

[73] Assignee: Bergwerksverband GmbH, Essen, Fed. Rep. of Germany

[21] Appl. No.: 479,110

[22] Filed: Mar. 28, 1983

Related U.S. Application Data

[63] Continuation of Ser. No. 257,408, Apr. 24, 1981, abandoned.

[30] Foreign Application Priority Data

Apr. 29, 1980 [DE] Fed. Rep. of Germany ..... 3016448

[51] Int. Cl.[3] ..... F26B 17/10

[52] U.S. Cl. ..... 34/57 D; 34/57 E; 34/229

[58] Field of Search ..... 110/245, 251; 34/57 A, 34/57 D, 57 E, 222, 229; 432/15, 58

[56] References Cited

U.S. PATENT DOCUMENTS

| | | | |
|---|---|---|---|
| 2,761,769 | 9/1956 | Elder | 34/57 D |
| 3,423,843 | 1/1969 | Laguilharre | 34/57 D |
| 3,605,274 | 9/1971 | Nara | 34/57 A |
| 4,043,051 | 8/1977 | Lussenden | 34/229 |
| 4,075,766 | 2/1978 | Michel et al. | 34/57 D |

FOREIGN PATENT DOCUMENTS

| | | | |
|---|---|---|---|
| 755579 | 8/1956 | United Kingdom | 34/57 D |

*Primary Examiner*—Larry I. Schwartz

*Attorney, Agent, or Firm*—Michael J. Striker

[57] ABSTRACT

A method for thermal treatment, especially drying, of finely particulated bulk material comprises the steps of stirring the material in a reactor by means of a rotating stirrer while simultaneously discharging a heated gas under pressure through openings in a hollow arm of the stirrer so as to form in the reactor a whirling fluidized bed from the material, and introducing the necessary amount of heat for the thermal treatment of the material at least in part through a heat exchanger extending into the whirling fluidized bed. The apparatus for carrying out the method mainly comprises an arrangement for feeding the material through an inlet into a reactor forming a whirling chamber in which a rotating stirring device is arranged having at least one hollow stirring arm provided with openings through which a preferably heated gas under pressure is discharged into the material so as to form a whirling fluidized bed in the reactor, a heat exchanger extending through the fluidized bed, and an outlet for discharging the gas and treated material from the reactor. The reactor may also include an arrangement extending into the whirling fluidized bed for retarding flow of the material from the inlet to the outlet of the reactor, which arrangement may be constituted by a heat exchanger of lamellar construction so that the material will pass in cascades through the reactor.

7 Claims, 4 Drawing Figures

METHOD AND APPARATUS FOR THERMAL TREATMENT, ESPECIALLY DRYING, OF FINELY COMMINUTED BULK MATERIAL

This application is a continuation, of application Ser. No. 257,408, filed Apr. 24, 1981, now abandoned.

BACKGROUND OF THE INVENTION

The present invention relates to a method for thermal treatment, especially drying, of finely comminuted bulk material as well as to an apparatus for carrying out this method and comprising a whirling fluidized bed reactor provided with an arrangement for feeding the material into the reactor means for feeding a whirling fluidizing gas into the reactor, a heating source connected to the reactor, and means for discharging the treated material and the fluidizing gas from the reactor.

During thermal treatment, especially drying, of finely particulated bulk material, such as pulverulent or dust-like material, as used in the chemical, pharmaceutical or foodstuffs industry, the uniformity of the treatment and the prevention of agglomeration of the material is of extreme importance.

It is known to dry such finely particulated material in contact driers. In a contact drier described in the book "Das Trocknen" by F. Kneule, published 1975 by Sauerlander, the material to be dried is transported by means of a screw conveyor while the heat necessary for the drying is indirectly transmitted to the material by means of a jacket heater. However, in this construction the powder is liable to form at the wall of the screw conveyor an insulating layer which prevents passing of the heat through the material. This requires a relatively high heat input and higher drying temperatures, which in turn may lead to the formation of heat nests. In a stream drier, described on pages 355–370 of the above mentioned book, the transport of the material is carried out by means of a heated air stream which is guided through a system of channels. Thereby, a direct heat exchange between the heated air and the powder is accomplished. To separate the powder from the transporting air, a cyclone is arranged downstream of the drier. In this drying arrangement, the time the powder remains in the drying phase is very small. This, in turn, requires a high temperature of the drying air, so that also in this method a relatively high heat requirement exists. In addition, the energy requirement for the transport of air and material to be dried is considerable. In a whirling drier, as described in the aforementioned book on pages 331–335, and further described in a book "Trockner und Trocknungsverfahren" by K. Kroell, published by Springer, 2nd edition, 1978, pages 238–246, a fluidized bed is produced by means of a heated air stream passing through an opening in the bottom into the material to be dried. The heat exchange occurs in this case directly between the heated air and the powder. For separating the heated air from the powder, a cyclone or filter is arranged downstream of the drying arrangement. In such a whirling layer drier the danger of locally overheating the material does not exist; however, the results of this last mentioned drier are not very satisfactory because the drying often occurs not uniformly.

SUMMARY OF THE INVENTION

It is an object of the invention to provide a method and apparatus for thermal treatment, especially drying, of finely particulated bulk material which avoids the disadvantages of such methods and apparatuses known in the art.

It is a further object of the present invention to provide a method and apparatus for the above mentioned purpose in which the thermal treatment of the material is uniform throughout, in which the necessary energy for carrying out the method is reduced as compared with the energy requirement of known methods, in which the formation of heat nests and caking of the material are avoided, to thus obtain a uniform drying of the material.

With these and other objects in view, which will become apparent as the description proceeds, the method according to the present invention for thermal treatment, especially drying, of finely particulated bulk material mainly comprises the steps of stirring the material in a reactor by means of a rotating stirrer while simultaneously discharging gas under pressure through openings in a hollow arm of the stirrer so as to form in the reactor a whirling fluidized bed from the material and introducing the necessary amount of heat for the thermal treatment of the material at least in part through a heat exchanger extending into the whirling fluidized bed. The gas discharged into the material may be a heated gas and 1–55% of the necessary amount of heat is introduced into the whirling bed by means of the heated gas, whereas 50–99% of the necessary heat may be introduced by means of a heat exchange medium passing through the heat exchanger.

The apparatus for carrying out the above method mainly comprises a reactor forming a whirling chamber, means communicating with the reactor for feeding the material into the latter, a source of heated gas under pressure, a heat source, stirring means in the reactor having at least one hollow stirring arm connected with a source of heated gas and provided with openings for discharging of the heated gas into the material introduced into the reactor so as to form a whirling fluidized bed from the material in the reactor, heat-exchange means connected to the heat source and extending into the whirling fluidized bed, and means communicating with the reactor at a location spaced from the feed-in means for discharging the material and the gas therefrom.

The at least one stirring arm may be located in a lowermost region of the reactor, and the discharge openings are preferably essentially downwardly directed. Drive means connected to the stirring arm rotates the latter in one direction, and the discharge opening, are arranged so that the gas emanating therefrom will have a component opposite to this one direction.

The apparatus may include means extending into the whirling fluidized bed in the reactor for retarding flow of material from the feed-in means to the discharge means, and the heat-exchange means may be constructed and arranged in the reactor to serve also as such flow-retarding means.

Extensive experimentation has shown that, surprisingly, the problem of properly thermally treating finely particulated material can be satisfactorily solved only by the combination of the features according to the present invention, that is a combination in which a whirling fluidized bed is maintained by whirling gases emanating from a rotating stirring arm and in which the thermal treatment occurs at least partially by a heat-exchange medium independent from the whirling gas.

The thermal treatment may principally comprise endothermic or exothermic processes, that is heat may be transmitted to or withdrawn from the material by the heat-exchange medium. The whirling gas may be used exclusively for maintaining the material in fluidized condition, or the gas may be such as to chemically react with the material, and finally, preferably, the gas may support the thermal treatment of the material, that is the gas may also be used for eliminating heat from the material, or preferably to introduce heat into the material in order to dry the finely comminuted material in a specific manner. Drying, in the sense according to the present invention, is to be understood to reduce the moisture content of the material in order to maintain in the latter a desired residual moisture content. Finally, comminuted material according to the present invention is to be understood to be material having a grain size diameter of less than 1 mm and mostly less than 0.1 mm. The whirling layer or the whirling fluidized bed according to the present invention has to be understood as the condition of the particulated material in which the latter behaves like a liquid in a container.

The heat-exchange medium according to the present invention can be of the recuperative or of the regenerative type. In the latter case, a solid material would be used as heat carrier, which is introduced into the reactor and which after heat treatment would be separated from the bulk material. However, a recuperative heat exchanger is preferred which is flown through by heat carrier fluid of any suitable kind.

Finally, the introduction of the necessary heat energy is to be understood to mean supply of heat energy into as well as drawing off heat from the fluidized bed.

According to the present invention it is possible, and depending on the heat treating process also desired, to use the same gas as whirling gas and also as heat carrying fluid, whereby a parallel or series connection is possible. As mentioned before, it has proven especially advantageous if 1–50% of the necessary heat energy is introduced into the material by the whirling gas and about 50–99% of the necessary heat energy is introduced by the heat-exchange medium. Preferred is therefore that the preponderant part of the heat transport occurs through the heat-exchange medium.

The feed-in means for the material comprise in the apparatus according to the present invention known devices, as for instance a supply container or hopper, a dosing device, a deagglomerator, a sluice or charging valve, and the same holds true for the discharging device which may for instance comprise a sluice or discharge valve. For introduction of the whirling gas into the material in the reactor may also devices known per se be used which are constructed for introducing of the gas into the material through openings in a stirring arm. It is also desirable to provide a separator downstream of the reactor for separating the whirling gas from the treated material.

According to the present invention, the stirring arm is preferably arranged in the bottom region of the reactor to prevent settling of the particulated material on the reactor bottom, and this prevention of settling of the material at the reactor bottom is further supported if, as mentioned before, the openings in the stirring arm are arranged such that the gas emanating therethrough is essentially downwardly directed and in such a manner that while the stirring arm is rotated in one direction, the gas emanating through these openings will have a component opposite to the direction of rotation of the stirring arm, whereby possibly forming agglomerations will be destroyed and a fluidizing of the material will also be obtained at the bottom of the reactor.

Preferably, the stirring arm is also provided with means for dispersing the material to avoid forming of agglomerations in the region of the stirring arm, and eventually also in the region of the reactor below the stirring arm. These means for dispersing the material, as well as the construction of the stirring arm, may be realized in different ways, and instead of a single stirring arm a plurality of circumferentially displaced stirring arms may be used.

The means extending into the fluidized bed for retarding movement of the particulated material from the inlet to the outlet may be constituted by weirs, walls or other installations which form narrow passages through which the material has to pass from the inlet to the outlet and which prevent a back-mixing of the particulated material while increasing the time the material will remain in the reactor.

According to the present invention such heat exchangers are especially advantageous which are constructed in such a manner as to serve at the same time for retarding flow of material from the inlet to the outlet of the reactor since the region of the aforementioned narrow passages the heat transmission between the particulated material and the heat exchange will be improved. For this purpose a lamellar construction of the heat exchanger, for instance a heat exchanger with projecting ribs, is especially advantageous.

The inlet for introducing the material into the reactor and the outlet for discharging the material from the reactor are preferably arranged in the upper region of the reactor and preferably to opposite sides of a weir extending in vertical direction through the fluidized bed formed in the reactor so that the material introduced into the latter has to flow to one side of the weir downwardly through the reactor and upwardly on the other side thereof.

Preferably, the reactor includes also a height-adjustable overflow device communicating with the interior of the reactor which facilitates operation of the reactor in a partial load region and the adjustment of the time the particulated material will remain in the reactor.

The objects according to the present invention are especially obtained in a cascade-like construction of the reactor. This is to be understood as an arrangement of a plurality of treating zones in series through which the particulated material has to pass. For instance, such cascades may be formed by consecutively arranged heat exchanger of lamellar construction.

The apparatus according to the present invention permits a continuous and automatic operation, whereby a treated material will be automatically discharged in the amount non-treated material is introduced into the apparatus.

The advantages derived from the present invention consist especially in the avoidance of trouble due to overheating or caking of the material, in the reduced heat requirement due to the advantageous combination of whirling gas and heat-exchange medium, and in the reduced energy for transport of the particulated material through the apparatus. An additional advantage resides in the reducing of the reactor volume, the reduction of the size of the cyclone for separating gas and particulated material downstream of the reactor, and the relatively small necessary surface of the heat exchanger in the reactor.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
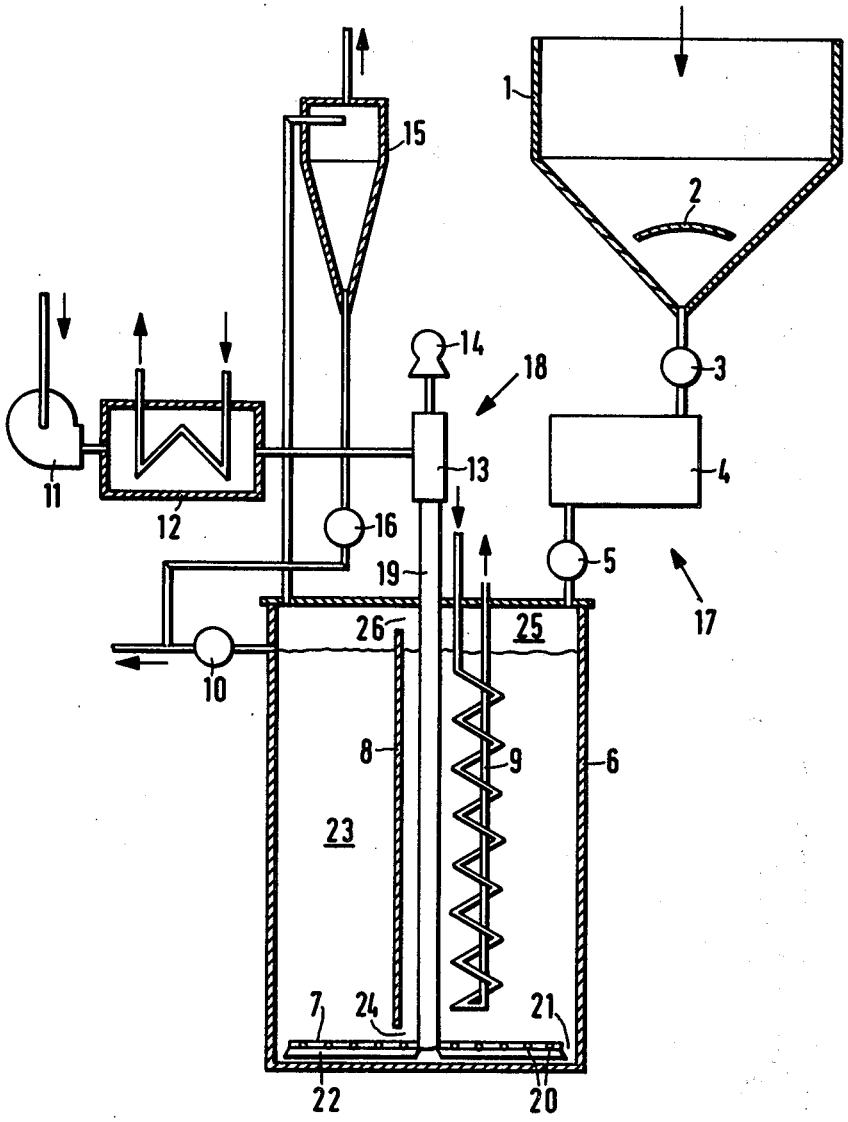
FIG. 1 is a schematic illustration of the apparatus according to the present invention, partially shown in longitudinal cross-section.

Referring now to the drawing, and more specifically to FIG. 1 of the same, it will be seen that the apparatus according to the present invention comprises a supply container or hopper 1 for the particulated material to be treated which is discharged from the hopper 1 over an auxiliary discharge device 2 and a dosing device 3 of known construction in a deagglomerator 4, likewise of known construction, to a sluice or discharging valve 5 into an upright reactor 6. A stirring arm 7, means 8 in form of a separating wall for retarding passing of the particulated material through the reactor 6, as well as a heat exchanger 9, are arranged in the reactor.

The treated material is discharged from the reactor over a sluice 10 of known construction.

The gas for maintaining the particulated material in the reactor 6 in a whirling fluidized bed is provided by a blower 11 passing the gas under pressure through heating means 12 and the thus heated gas is passed through a rotary joint 13 and through a hollow shaft 19 driven by a motor 14 into a hollow stirring arm 7 projecting normal to the shaft 19 to opposite sides thereof. The stirring arm 7 is provided with outlet openings 20 for the gas.

The gas leaving the reactor 6 is freed from the particles carried thereby in a separator 15 and discharged from the latter to be used again, whereas the particles separated from the gas in the separator 15 are introduced through the sluice 16 into the material stream which is discharged over the sluice 10 from the reactor 6.

The elements 1–5 form together components of means 17 for feeding particulated material into the reactor 6, whereas the sluice 10 forms part of a discharging device for discharging the treated material from the reactor 6. The blower 11 and the rotating joint 13 form part of the means for introducing a whirling gas into the reactor, whereas the separator or cyclone 15 forms part of the discharge device. The heating means 12 may, in a manner not illustrated in the drawing, also alternatively or additionally be used for the heat carrier fluid in the heat exchanger 9.

The stirring arrangement 18 comprises the drive motor 14, the rotary joint 13, the shaft 19 as well as the stirring arm 7 extending to opposite sides of the shaft. The shaft 19 and the stirring arm 7 are hollow so that the heated gas will pass therethrough and leave the stirring arm 7 through the outlet openings 20 provided therein.

The stirring arm 7 is located at the bottom region 21 of the reactor 6. The outlet openings 20 in the stirring arm are essentially downwardly directed and arranged in such a manner that the gas passing therethrough will have a component in a direction opposite the turning direction of the stirring arm 7. In addition, the stirring arm is provided with cleaning blade like constructed means 22 for dispersing of material.

A wall 8, forming means for retarding flow of material from the inlet to the outlet of the reactor 6, extends transverse to the general flow of the particulated material through the fluidized whirling bed 23 and being provided in the bottom region of the reactor with an opening 24 for the stirring arm 7 and for the passing of the particulate material as well as in the upper region 25 of the reactor with an opening 26 for the passage of the gas.

Due to the particular arrangement of the heat exchanger 9 in the reactor 6 with respect to the wall 8 and the feed-in arrangement 17, the heat exchange between the freshly introduced particulated material is carried out in an especially intensive manner.

Figure 2:
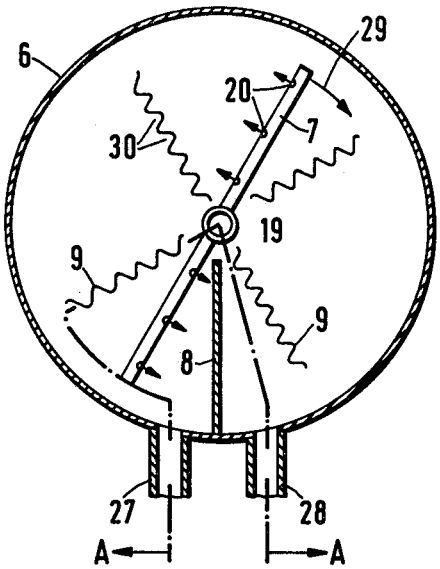
FIG. 2 is a horizontal cross-section through a cylindrical reactor.

The reactor shown in horizontal cross-section in FIG. 2 is cylindrical and it is understood that the stirring arrangement 18 is constructed in the same manner as in FIG. 1. The inlet 27 and the outlet 28 are arranged adjacent to each other and to opposite sides of the separating wall 8 which in this case extends radially inwardly from the peripheral wall of the reactor 6 closely adjacent to the shaft 19 of the stirrer. It is to be understood that the wall 8 provides openings 26 and 24 as described in connection with FIG. 1. From this result, within the reactor, a transport direction for the particulate material substantially in the direction of rotation 29 of the stirring arm 7. A plurality of heat exchangers 9 extend in radial direction circumferentially spaced from each other through the fluidized bed 23 in the reactor 6, and these heat exchangers have a surface extending in vertical direction through the reactor and forming narrow passages 30 for guiding the particulated material in vertical direction. The thus constructed heat exchangers 9 likewise form means for retarding flow of the particulated material through the reactor and their particular arrangement will result in a cascade-like construction of the reactor. The thus formed heat exchangers have a general lamellar construction. It is to be understood that these heat exchangers 9 end, in the same manner as the wall 8, short of the top and the bottom wall of the reactor.

Figure 3:
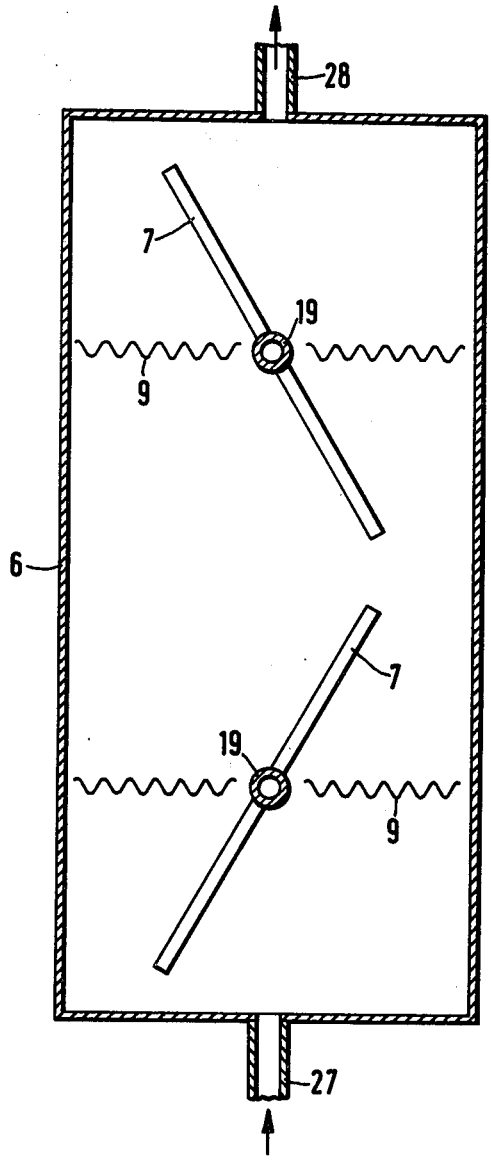
FIG. 3 is a horizontal cross-section through a rectangular reactor.

FIG. 3 schematically illustrates in a horizontal cross-section a reactor 6 of rectangular cross-section in which the inlet 27 and the outlet 28 are arranged at the short sides of the rectangle, and in which a plurality, for instance as illustrated in FIG. 3, two complete stirring arrangements 18, each including a driven hollow stirring shaft 19 and a stirring arm 7 projecting to opposite sides of the latter as described in connection with FIG. 1, are provided spaced from each other in the direction of the long sides of the rectangular reactor. The heat exchangers 9 are constructed similar as in FIG. 2, and permit due to suitable interruptions a free rotation of the stirring arms 7 which may be arranged, at different heights and also with a plurality of vertically spread arms on each shaft 19, in the reactor 6. Due to the arrangement of the heat exchangers 9 in direction transverse to the direction of the passage of the particulated material through the reactor, there is again a cascade-like construction of the reactor realized.

Figure 4:
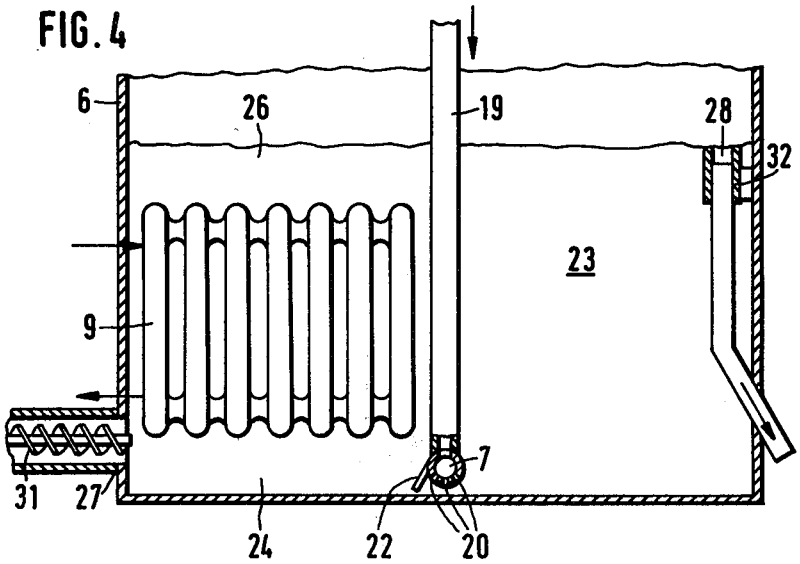
FIG. 4 is a cross-section taken along the line A—A through the reactor of FIG. 2.

FIG. 4 illustrates further details of the reactor illustrated in FIG. 2. In this construction the particulated material to be treated in the reactor is introduced into the latter by means of a feed screw 31, and the discharge of the material is provided by means of a height-adjustable overflow discharge device 32.

It will be understood that each of the elements described above, or two or more together, may also find a useful application in other types of methods and apparatus for thermal treatment of finely particulated material, differing from the types described above.

While the invention has been illustrated and described as embodied in a method and apparatus for thermal treatment, especially drying, finely particulated material, in which a whirling fluidized bed is maintained in the apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for thermal treatment, especially drying, of finely particulated bulk material, comprising a reactor; means communicating with the interior of the reactor for feeding the material into the latter; a source of gas under pressure; a heat source; stirring means in the reactor having at least one hollow stirring arm connected to said source of gas and provided with openings for discharge of the gas into the material introduced into the reactor so as to form a whirling fluidized bed from the material in the reactor; heat-exchanger means connected to said heat source and extending into the whirling fluidized bed; means communicating with said reactor at a location spaced from said feeding means for discharging the material and the gas therefrom, said at least one stirring arm being located in a lowermost region of said reactor; means extending into the whirling fluidized bed in the reactor for retarding flow of the material from said feeding means to said discharge means, said reactor being constructed so that the material passes in cascades therethrough, said reactor being an upright reactor, said feeding means and said discharge means being located in the region of the upper end of said reactor; and a height-adjustable overflow device for adjusting the height of the material and communicating with the interior of said reactor.

2. Apparatus as defined in claim 1, wherein said discharge openings are essentially downwardly directed.

3. Apparatus as defined in claim 1, and including means for rotating said stirring arm in one direction and wherein said discharge openings are arranged so that the gas emanating therefrom will have a component in a direction opposite to said one direction.

4. Apparatus as defined in claim 1, and including means on said stirring arm for dispersing the material.

5. Apparatus as defined in claim 1, wherein said heat-exchanger means are constructed and arranged in said reactor to serve also as said flow retarding means.

6. Apparatus as defined in claim 5, wherein said heat exchanger means are of lamellar construction.

7. Apparatus as defined in claim 1, and including means downstream of said discharge means for separating the treated material from said gas.

* * * * *